US011154789B1

(12) United States Patent
Li et al.

(10) Patent No.: US 11,154,789 B1
(45) Date of Patent: Oct. 26, 2021

(54) NON-ELECTRIC TOY TRANSMISSION SYSTEM

(71) Applicant: Shenzhen GaiBoSi Trading Co., Ltd., Shenzhen (CN)

(72) Inventors: Kaikai Li, Xi'an (CN); Bo Hu, Xi'an (CN); Chao Yang, Wuhan (CN)

(73) Assignee: Shenzhen GaiBoSi Trading Co., Ltd., Shenzhen (CN)

( * ) Notice: Subject to any disclaimer, the term of this patent is extended or adjusted under 35 U.S.C. 154(b) by 0 days.

(21) Appl. No.: 17/330,423

(22) Filed: May 26, 2021

(30) Foreign Application Priority Data

Sep. 7, 2020 (CN) ..... 202021953505.7

(51) Int. Cl.
*A63H 29/10* (2006.01)
*A63H 30/06* (2006.01)
*A63H 29/24* (2006.01)

(52) U.S. Cl.
CPC ..... *A63H 30/06* (2013.01); *A63H 29/24* (2013.01)

(58) Field of Classification Search
CPC ..... A63H 29/10; A63H 29/24; A63H 30/06
USPC ..... 446/176, 180, 426, 199, 424, 425, 427
See application file for complete search history.

(56) References Cited

U.S. PATENT DOCUMENTS 3,731,428 A * 5/1973 Glass ..... A63H 31/00 446/428
4,712,968 A * 12/1987 Manning ..... A63H 17/12 180/329
4,998,903 A * 3/1991 Bolli ..... A63H 31/10 446/102
5,435,768 A * 7/1995 Dunleavy ..... A63H 17/05 446/427
6,264,528 B1 * 7/2001 Doan ..... A63H 17/06 280/685
6,346,024 B1 * 2/2002 Engel ..... A63H 23/00 401/1
6,416,380 B1 * 7/2002 Li-Wen ..... A63H 3/20 446/330
6,568,984 B1 * 5/2003 Applewhite ..... A63H 3/48 446/176
7,513,521 B2 * 4/2009 Posselius ..... A01B 61/02 280/463
8,220,260 B2 * 7/2012 Harris ..... F15B 15/10 60/533

(Continued)

*Primary Examiner* — Alexander R Niconovich
(74) *Attorney, Agent, or Firm* — True Shepherd LLC; Andrew C. Cheng

(57) ABSTRACT

The disclosure relates to the technical field of toys, and provides a non-electric toy transmission system, to resolve a prior-art technical problem that an electric toy transmission mechanism has high use costs and a short service life. Technical solutions in the disclosure are as follows: The non-electric toy transmission system includes an instruction apparatus, an execution apparatus, a pipeline, and a transmission medium, where the instruction apparatus and the execution apparatus are connected by the pipeline, and the instruction apparatus, the execution apparatus, and the pipeline are filled with the transmission medium; and the instruction apparatus is capable of being triggered to enable the transmission medium in the instruction apparatus to enter the execution apparatus through the pipeline, and the execution apparatus completes, under pressure of the transmission medium, an action designed for a toy.

8 Claims, 3 Drawing Sheets

(56) References Cited

U.S. PATENT DOCUMENTS

| | | | | |
|---|---|---|---|---|
| 8,540,547 | B2 * | 9/2013 | Ibarra | A63H 30/04 446/426 |
| 9,914,065 | B2 * | 3/2018 | Almog | H05K 3/326 |
| 2003/0104756 | A1 * | 6/2003 | Gordon | A63H 17/045 446/154 |
| 2021/0233421 | A1 * | 7/2021 | Lee | F21V 33/008 |

* cited by examiner

NON-ELECTRIC TOY TRANSMISSION SYSTEM

TECHNICAL FIELD

The disclosure relates to the technical field of toys, and in particular, to a non-electric toy transmission system.

BACKGROUND

Toys provide support for children to turn their mental processes such as imagination and thinking into behaviors. Children's toys can develop sports abilities, train perception, stimulate imagination, arouse curiosity, and provide material conditions for children's physical and mental development. With the rapid development of economy and the continuous improvement of people's living standards, the toy market has gradually expanded from children to all age groups. For example, LEGO toys have been used by all ages including adults. On the market, assembled and educational toys are the most popular, and are made of plastic, metal, and wood, etc.

Most existing assembled toys internally use an electric transmission mechanism, and the transmission process is usually as follows: motor-gear set-actuator or electric telescopic rod-transmission frame-executable structure. This kind of electric toy transmission mechanism uses a battery as a power source, and the battery needs to be constantly replaced in a process of using the toy. This is not environmental friendly and results in high use costs. In addition, the electric transmission mechanism has poor water resistance and a high failure rate, which may shorten a service life of the toy.

SUMMARY

To resolve a prior-art technical problem that an electric toy transmission mechanism has high use costs and a short service life, the disclosure provides the following technical solutions:

The disclosure provides a non-electric toy transmission system, including an instruction apparatus, an execution apparatus, a pipeline, and a transmission medium, where the instruction apparatus is a control end of a toy, and is designed in a form of a control handle, a control button, or the like; the execution apparatus is a terminal for performing an action designed for the toy, and is configured to execute a command of the instruction apparatus to perform an action; the pipeline is configured to connect the instruction apparatus and the execution apparatus; and the transmission medium is a carrier for transmitting command information. The instruction apparatus and the execution apparatus are connected by the pipeline, and the instruction apparatus, the execution apparatus, and the pipeline are filled with the transmission medium; and the instruction apparatus is capable of being triggered to enable the transmission medium in the instruction apparatus to enter the execution apparatus through the pipeline, and the execution apparatus completes, under pressure of the transmission medium, the action designed for the toy.

Compared with a traditional electric structure using a battery as a power source, the non-electric toy transmission system in the disclosure has the following advantages: There is no need to purchase or replace a battery when using the toy, thereby reducing use costs of the toy. The toy does not need to be charged frequently, thereby reducing maintenance workload of the toy. A non-electric structure is used, and has a low requirement for overall waterproofness of the toy, thereby reducing corresponding design and production costs. In addition, a case in which the toy becomes invalid after being damped is eliminated, thereby prolonging a service life of the toy.

In a possible design, the instruction apparatus and the execution apparatus have a same structure and each include a piston shaft and an outer cylinder sleeved on the piston shaft; one end of the outer cylinder is an entrance for inserting the piston shaft, and the other end of the outer cylinder is a medium outlet; the piston shaft extends into the outer cylinder, and is slidably and sealingly connected to an inner wall of the outer cylinder; a cavity is formed between the outer cylinder and the piston shaft, and the cavity is filled with the transmission medium; and the cavity of the instruction apparatus is connected to the cavity of the execution apparatus by the pipeline.

During working, the piston shaft of the instruction apparatus is pressed to push the transmission medium into the cavity of the execution apparatus through the pipeline, and the transmission medium acts on the piston shaft of the execution apparatus to enable the piston shaft of the execution apparatus to move outward from the outer cylinder of the execution apparatus. This design can enable the piston shaft of the execution apparatus to perform retractable linear motion.

Further, the piston shaft of the execution apparatus is provided with a corresponding functional module to enrich playability of the toy. For example, for a toy of a lifting table type, a hinged connecting rod is designed on the piston shaft, and a motion mode of a scissor-type lifting table in the prior art is imitated through stretching or shrinking of the piston shaft.

In a possible design, the end, at which the medium outlet is disposed, of the outer cylinder is further provided with a medium feeding inlet, and the medium feeding inlet is provided with a one-way valve whose flow direction points to the inside of the outer cylinder. When a medium in a transmission line between the instruction apparatus and the execution apparatus is missing, and a transmission failure is caused, the medium feeding inlet can be interconnected with an outer pipe, and then the transmission medium is supplemented to the transmission line.

In a possible design, there are a plurality of instruction apparatuses and a plurality of execution apparatuses, and the plurality of instruction apparatuses one-to-one correspond to the plurality of execution apparatuses. Therefore, the toy can be designed more complicatedly.

In a possible design, the non-electric toy transmission system further includes an instruction-side mounting rack, where the plurality of instruction apparatuses are mounted on the instruction-side mounting rack. As described above, the instruction apparatus is the control end of the toy. To facilitate pressing by a user and instruction sending, the instruction apparatus is packaged by the instruction-side mounting rack. In this way, the user controls the instruction-side mounting rack, and then triggers the instruction apparatus.

In a possible design, the instruction-side mounting rack includes a first trigger component, the first trigger component includes a first support base and a pressing portion, the outer cylinder is secured on the first support base, the first support base is provided with a guide groove, the pressing portion is of an L-shaped structure, an inner side of one arm of the pressing portion is butted with the piston shaft, and the other arm of the pressing portion passes through the guide groove.

In use, the pressing portion is pressed to slide along the guide groove, to further drive the piston shaft to move in the outer cylinder. In this way, the instruction apparatus is triggered.

A structure of the first trigger component is not conducive to reverse movement of the piston shaft. Therefore, a reverse trigger instruction cannot be executed. Further, the first trigger component further includes a reset spring. The reset spring is disposed outside the piston shaft.

Optionally, the reset spring may be disposed on any piston shaft in a line between the instruction apparatus and the execution apparatus, in other words, may be disposed on the instruction apparatus or on the execution apparatus.

In a possible design, the instruction-side mounting rack further includes a second trigger component, the second trigger component includes a second support base and a pushing portion, the second support base is assembled by a plurality of splicing plates, the outer cylinder is hinged inside the second support base, and the pushing portion is hinged with the second support base and the piston shaft in sequence.

In use, the pushing portion is pushed to change an included angle between the pushing portion and the second support base, to further drive the piston shaft to move in the outer cylinder.

In a possible design, the instruction-side mounting rack further includes a third trigger component, the third trigger component includes a third support base and a lateral swinging portion, the outer cylinder is secured on the third support base, the lateral swinging portion is hinged with an upper part of the second support base, a sliding post is disposed outside the piston shaft, the lateral swinging portion is provided with a sliding groove that cooperates with the sliding post, and the third support base is provided with a sliding rail for overlapping the sliding post.

In use, the lateral swinging portion is swung to enable the sliding groove to drive the sliding post to slide on the sliding rail, to further drive the piston shaft to move in the outer cylinder.

In a possible design, the transmission medium is gas or liquid.

Figure 1:
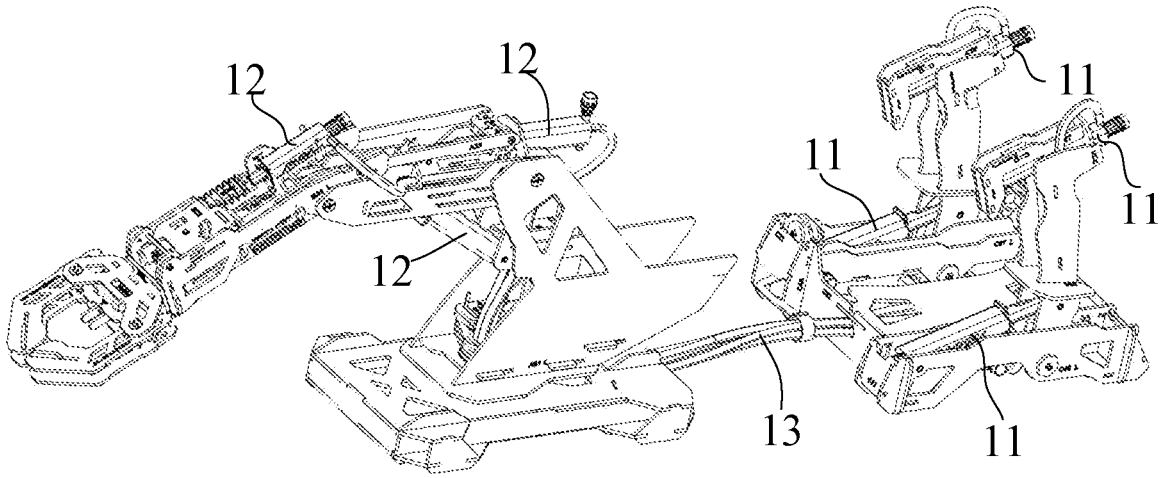
FIG. 1 is a schematic diagram of a non-electric toy transmission system according to an embodiment of the disclosure.

Reference numerals: 11: instruction apparatus; 111: piston shaft; 112: outer cylinder; 113: medium feeding inlet; 12: execution apparatus; 13: pipeline; 14: base control arm; 141: unit arm; 15: control arm seat; 151: cam; 152: transmission block; 153: swinging groove; 154: sliding rod; 161: first support base; 162: pressing portion; 163: guide groove; 171: second support base; 172: pushing portion; 173: hinge joint; 181: third support base; 182: lateral swinging portion; 183: sliding post; 184: sliding groove; 185: sliding rail; and 19: reset spring.

DETAILED DESCRIPTION

The following describes the technical solutions in the disclosure with reference to the accompanying drawings. Apparently, the described embodiments are merely a part, rather than all of the embodiments of the disclosure.

In the description of the disclosure, it should be noted that unless otherwise expressly specified and defined, terms such as "mounted", "connected to each other", and "connected to" should be comprehended in a broad sense. For example, the "connection" may be a fixed connection, a removable connection, or an integral connection; may be a mechanical connection, an electrical connection, or mutual communication; may be a direct connection or an indirect connection using an intermediate medium; or may be a connection or an interaction relationship between two elements. A person of ordinary skill in the art may understand specific meanings of the foregoing terms in the disclosure based on a specific situation.

In the description of the disclosure, it should be understood that orientation or position relationships indicated by terms "upper", "lower", "lateral", "inner", "outer", "top", "bottom", and the like are orientation or position relationships as shown in the drawings, and these terms are just used to facilitate description of the disclosure and simplify the description, but not to indicate or imply that the mentioned apparatus or elements must have a specific orientation and must be constructed and operated in a specific orientation, and thus, these terms cannot be understood as a limitation to the disclosure.

It should also be noted that, in the embodiments of the disclosure, a same reference numeral represents a same constituent part or a same component or part. For same components or parts in the embodiments of the disclosure, only one of the components or parts may be taken as an example to mark the reference numeral. It should be understood that the reference numeral is also applicable to other same components or parts.

Figure 2:
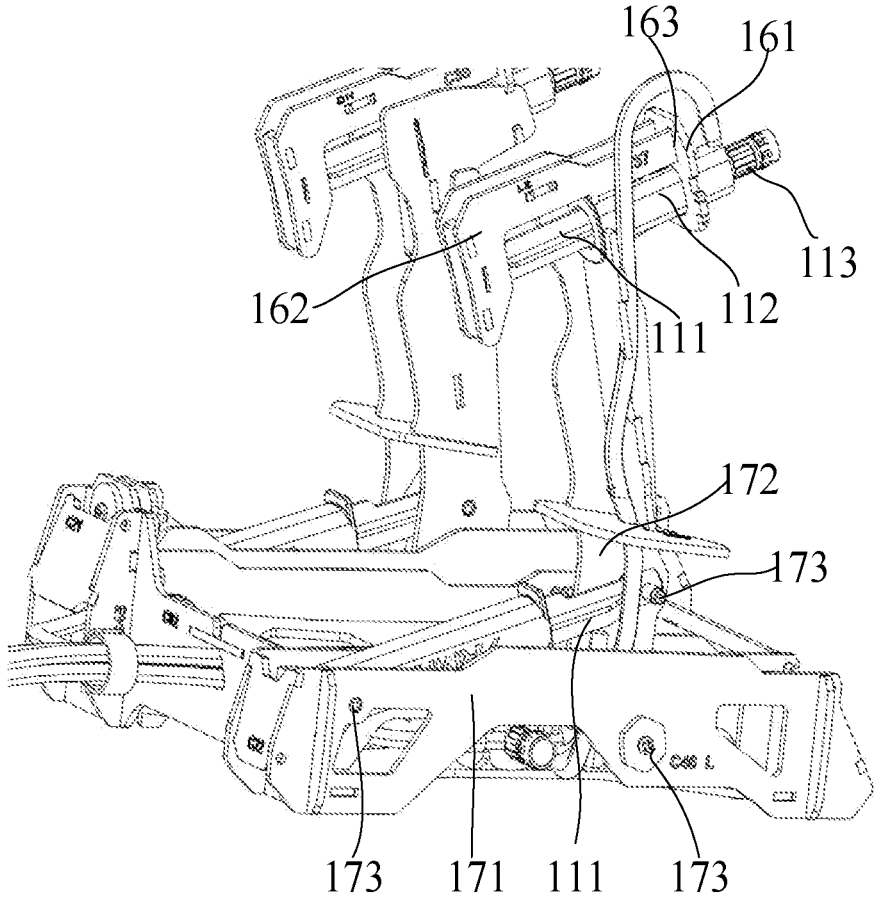
FIG. 2 is a schematic diagram of an instruction apparatus according to an embodiment of the disclosure.

As shown in FIG. 1 and FIG. 2, an embodiment provides a non-electric toy transmission system, including an instruction apparatus 11, an execution apparatus 12, a pipeline 13, and a transmission medium. The instruction apparatus 11 is a control end of a toy, and is designed in a form of a control handle, a control button, or the like. The execution apparatus 12 is a terminal for performing an action designed for the toy, and is configured to execute a command of the instruction apparatus 11 to perform an action. The pipeline 13 is configured to connect the instruction apparatus 11 and the execution apparatus 12. The transmission medium is a carrier of transmitting command information. The instruction apparatus 11 and the execution apparatus 12 are connected by the pipeline 13, and the instruction apparatus 11, the execution apparatus 12, and the pipeline 13 are filled with the transmission medium. The instruction apparatus 11 is capable of being triggered to enable the transmission medium in the instruction apparatus 11 to enter the execution apparatus 12 through the pipeline 13, and the execution apparatus 12 completes, under pressure of the transmission medium, the action designed for the toy.

Compared with a traditional electric structure using a battery as a power source, the non-electric toy transmission system in this embodiment has the following advantages: There is no need to purchase or replace a battery when using the toy, thereby reducing use costs of the toy. The toy does not need to be charged frequently, thereby reducing maintenance workload of the toy. A non-electric structure is used, and has a low requirement for overall waterproofness of the toy, thereby reducing corresponding design and production costs. In addition, a case in which the toy becomes invalid after being damped is eliminated, thereby prolonging a service life of the toy.

In an embodiment, the instruction apparatus 11 and the execution apparatus 12 have a same structure and each include a piston shaft 111 and an outer cylinder 112 sleeved on the piston shaft 111; one end of the outer cylinder 112 is an entrance for inserting the piston shaft 111, and the other end of the outer cylinder 112 is a medium outlet; the piston shaft 111 extends into the outer cylinder 112, and is slidably and sealingly connected to an inner wall of the outer cylinder 112; a cavity is formed between the outer cylinder 112 and the piston shaft 111, and the cavity is filled with the transmission medium; and the cavity of the instruction apparatus 11 is connected to the cavity of the execution apparatus 12 by the pipeline 13.

During working, the piston shaft 111 of the instruction apparatus 11 is pressed to push the transmission medium into the cavity of the execution apparatus 12 through the pipeline 13, and the transmission medium acts on the piston shaft 111 of the execution apparatus 12 to enable the piston shaft 111 of the execution apparatus 12 to move outward from the outer cylinder 112 of the execution apparatus 12. This design can enable the piston shaft 111 of the execution apparatus 12 to perform retractable linear motion.

Further, the piston shaft 111 of the execution apparatus 12 is provided with a corresponding functional module to enrich playability of the toy. For example, for a toy of a lifting table type, a hinged connecting rod is designed on the piston shaft 111, and a motion mode of a scissor-type lifting table in the prior art is imitated through stretching or shrinking of the piston shaft 111.

Figure 4:
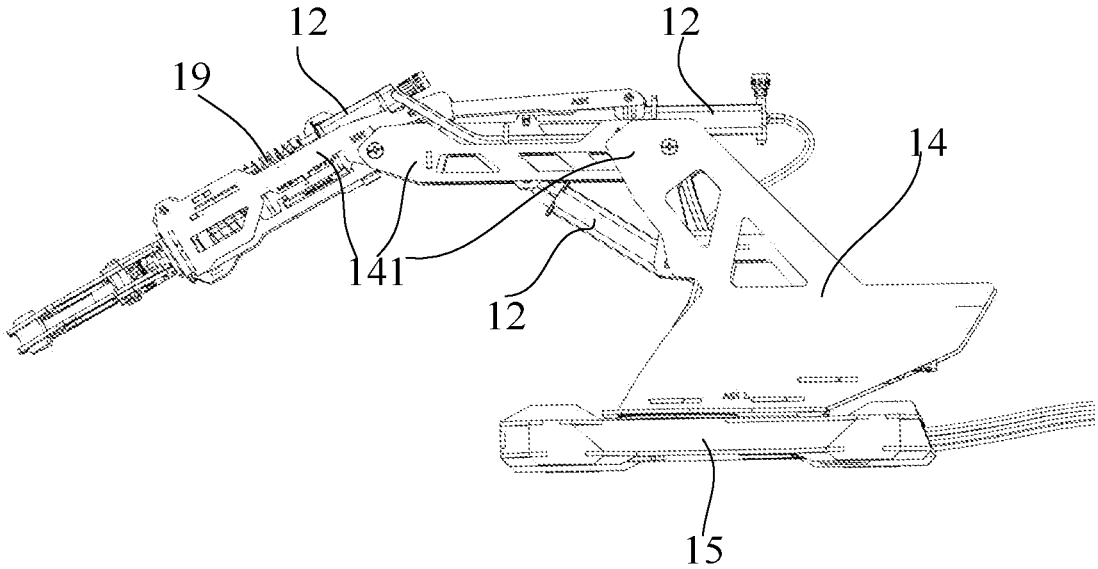
FIG. 4 is a schematic diagram of applying the disclosure to a toy imitating engineering machinery.
Figure 5:
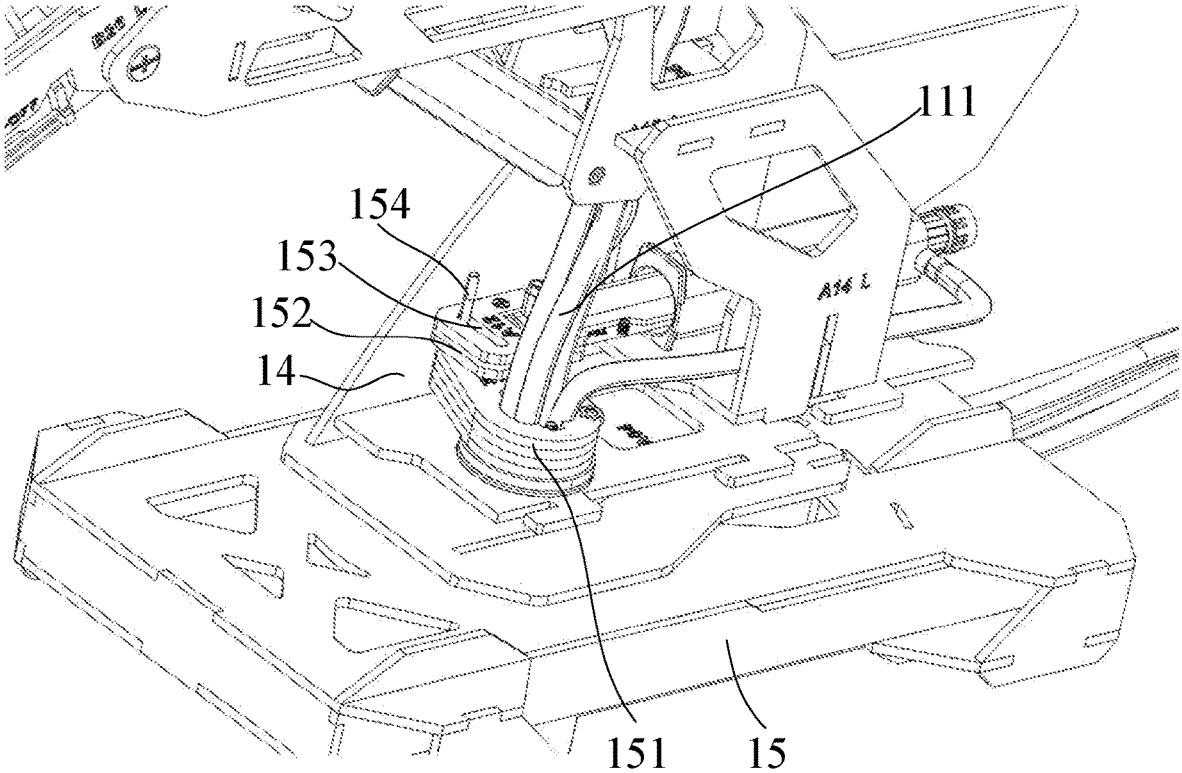
FIG. 5 is a schematic diagram of a control arm seat when the disclosure is applied to a toy imitating engineering machinery.

For another example, as shown in FIG. 4 and FIG. 5, for a toy imitating engineering machinery, an execution end includes a base control arm 14 and a control arm seat 15 disposed at the bottom of the base control arm 14. The base control arm 14 is constituted by a plurality of segments of unit arms 141, each two segments of unit arms 141 are hinged, and the execution apparatus 12 is hinged inside an included angle between each two segments of unit arms 141. A stretching or shrinking length of the piston shaft 111 of the execution apparatus 12 is changed to further change a placement angle of the base control arm 14. The control arm seat 15 includes a cam 151, a bearing, and a transmission block 152. The cam 151 and the bottom of the base control arm 14 are circumferentially fixed with an inner ring of the bearing, an outer ring of the bearing is fixed with the control arm seat 15, the transmission block 152 is provided with a swinging groove 153 and is fixed with the piston shaft 111 of the execution apparatus 12, and the cam 151 is provided with a sliding rod 154 that cooperates with the swinging groove 153 of the transmission block 152. The instruction apparatus 11 is capable of being triggered to drive the piston shaft 111 to move, to further drive, through cooperation between the swinging groove 153 and the sliding rod 154, the cam 151 and the base control arm 14 to rotate.

In an embodiment, the end, at which the medium outlet is disposed, of the outer cylinder 112 is further provided with a medium feeding inlet 113, and the medium feeding inlet 113 is provided with a one-way valve whose flow direction points to the inside of the outer cylinder 112. When a medium in a transmission line between the instruction apparatus 11 and the execution apparatus 12 is missing, and a transmission failure is caused, the medium feeding inlet can be interconnected with an outer pipe, and then the transmission medium is supplemented to the transmission line.

In an embodiment, there are a plurality of instruction apparatuses 11 and a plurality of execution apparatuses 12, and the plurality of instruction apparatuses 11 one-to-one correspond to the plurality of execution apparatuses 12. Therefore, the toy can be designed more complicatedly.

As shown in FIG. 2, in an embodiment, the non-electric toy transmission system further includes an instruction-side mounting rack, where the plurality of instruction apparatuses 11 are mounted on the instruction-side mounting rack. As described above, the instruction apparatus 11 is the control end of the toy. To facilitate pressing by a user and instruction sending, the instruction apparatus 11 is packaged by the instruction-side mounting rack. In this way, the user controls the instruction-side mounting rack, and then triggers the instruction apparatus 11.

In an embodiment, the instruction-side mounting rack includes a first trigger component, the first trigger component includes a first support base 161 and a pressing portion 162, the outer cylinder 112 is secured on the first support base 161, the first support base 161 is provided with a guide groove 163, the pressing portion 162 is of an L-shaped structure, an inner side of one arm of the pressing portion 162 is butted with the piston shaft 111, and the other arm of the pressing portion 162 passes through the guide groove 163.

In use, the pressing portion 162 is pressed to slide along the guide groove 163, to further drive the piston shaft 111 to move in the outer cylinder 112. In this way, the instruction apparatus 11 is triggered.

A structure of the first trigger component is not conducive to reverse movement of the piston shaft 111. Therefore, a reverse trigger instruction cannot be executed. Further, the first trigger component further includes a reset spring 19. The reset spring is 19 disposed outside the piston shaft 111.

Optionally, the reset spring 19 may be disposed on any piston shaft 111 in a line between the instruction apparatus 11 and the execution apparatus 12, in other words, may be disposed on the instruction apparatus 11 or on the execution apparatus 12.

In an embodiment, the instruction-side mounting rack further includes a second trigger component, the second trigger component includes a second support base 171 and a pushing portion 172, the second support base 171 is assembled by a plurality of splicing plates, the outer cylinder 112 is hinged inside the second support base 171, and the pushing portion 172 is hinged with the second support base 171 and the piston shaft 111 in sequence to form a structure like a triangle. Each vertex of the triangle is a hinge joint 173.

In use, the pushing portion 172 is pushed to change an included angle between the pushing portion 172 and the second support base 171, to further drive the piston shaft 111 to move in the outer cylinder 112.

Figure 3:
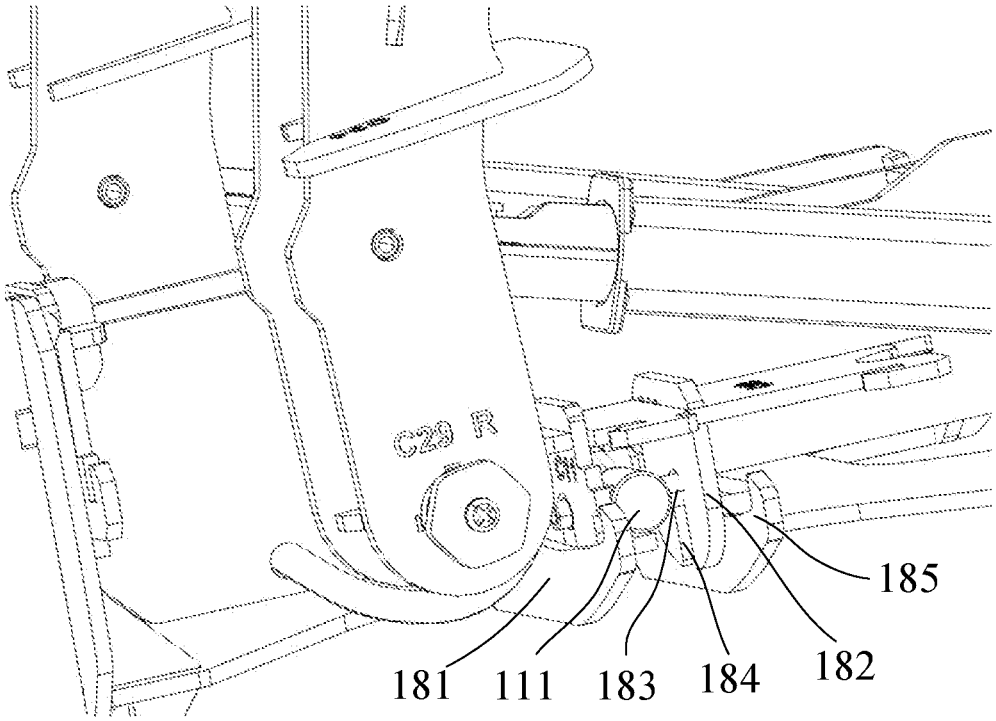
FIG. 3 is a schematic diagram of a third trigger component according to an embodiment of the disclosure.

As shown in FIG. 3, in an embodiment, the instruction-side mounting rack further includes a third trigger component, the third trigger component includes a third support base 181 and a lateral swinging portion 182, the outer cylinder 112 is secured on the third support base 181, the lateral swinging portion 182 is hinged with an upper part of the second support base 171, a sliding post 183 is disposed outside the piston shaft 111, the lateral swinging portion 182 is provided with a sliding groove 184 that cooperates the sliding post 183, and the third support base 181 is provided with a sliding rail 185 for overlapping the sliding post 183.

In use, the lateral swinging portion 182 is swung to enable the sliding groove 184 to drive the sliding post 183 to slide on the sliding rail 185, to further drive the piston shaft 111 to move in the outer cylinder 112.

Preferably, in an embodiment, the transmission medium is liquid.

The above described are merely specific implementations of the disclosure, and the protection scope of the disclosure is not limited thereto. Any modification or replacement easily conceived by those skilled in the art within the technical scope of the disclosure should fall within the protection scope of the disclosure. Therefore, the protection scope of the disclosure shall be the protection scope of the claims.

What is claimed is:

1. A non-electric toy transmission system, comprising an instruction apparatus (11), an execution apparatus (12), a pipeline (13), a transmission medium, and an instruction-side mounting rack, wherein the instruction apparatus (11) and the execution apparatus (12) are connected by the pipeline (13), and the instruction apparatus (11), the execution apparatus (12), and the pipeline (13) are filled with the transmission medium; and the instruction apparatus (11) is capable of being triggered to enable the transmission medium in the instruction apparatus (11) to enter the execution apparatus (12) through the pipeline (13), and the execution apparatus (12) completes, under pressure of the transmission medium, an action designed for a toy;

the instruction apparatus (11) comprises a piston shaft (111) and an outer cylinder (112) sleeved on the piston shaft (111); a plurality of instruction apparatuses (11) are mounted on the instruction-side mounting rack;

the instruction-side mounting rack comprises a first trigger component, the first trigger component comprises a first support base (161) and a pressing portion (162), the outer cylinder (112) is secured on the first support base (161), the first support base (161) is provided with a guide groove (163), the pressing portion (162) is of an L-shaped structure, an inner side of one arm of the pressing portion (162) is butted with the piston shaft (111), and other arm of the pressing portion (162) passes through the guide groove (163); and the pressing portion (162) is pressed to slide along the guide groove (163), to further drive the piston shaft (111) to move in the outer cylinder (112).

2. The non-electric toy transmission system according to claim 1, wherein the instruction apparatus (11) and the execution apparatus (12) have a same structure and each comprise the piston shaft (111) and the outer cylinder (112) sleeved on the piston shaft (111); one end of the outer cylinder (112) is an entrance for inserting the piston shaft (111), and the other end of the outer cylinder (112) is a medium outlet; the piston shaft (111) extends into the outer cylinder (112), and is slidably and sealingly connected to an inner wall of the outer cylinder (112); a cavity is formed between the outer cylinder (112) and the piston shaft (111), and the cavity is filled with the transmission medium; and a cavity of the instruction apparatus (11) is connected to a cavity of the execution apparatus (12) by the pipeline (13); and the piston shaft (111) of the instruction apparatus (11) is pressed to push the transmission medium into the cavity of the execution apparatus (12) through the pipeline (13), and the transmission medium acts on the piston shaft (111) of the execution apparatus (12) to enable the piston shaft (111) of the execution apparatus (12) to move outward from the outer cylinder (112) of the execution apparatus (12).

3. The non-electric toy transmission system according to claim 2, wherein the end, at which the medium outlet is disposed, of the outer cylinder (112) is further provided with a medium feeding inlet (113), and the medium feeding inlet (113) is provided with a one-way valve whose flow direction points to an inside of the outer cylinder (112).

4. The non-electric toy transmission system according to claim 3, wherein there are a plurality of execution apparatuses (12), and the plurality of instruction apparatuses (11) one-to-one correspond to the plurality of execution apparatuses (12).

5. The non-electric toy transmission system according to claim 1, wherein the first trigger component further comprises a reset spring (19), and the reset spring (19) is disposed outside the piston shaft (111).

6. The non-electric toy transmission system according to claim 5, wherein the instruction-side mounting rack further comprises a second trigger component, the second trigger component comprises a second support base (171) and a pushing portion (172), the second support base (171) is assembled by a plurality of splicing plates, the outer cylinder (112) is hinged inside the second support base (171), and the pushing portion (172) is hinged with the second support base (171) and the piston shaft (111) in sequence; and the pushing portion (172) is pushed to change an included angle between the pushing portion (172) and the second support base (171), to further drive the piston shaft (111) to move in the outer cylinder (112).

7. The non-electric toy transmission system according to claim 6, wherein the instruction-side mounting rack further comprises a third trigger component, the third trigger component comprises a third support base (181) and a lateral swinging portion (182), the outer cylinder (112) is secured on the third support base (181), the lateral swinging portion (182) is hinged with an upper part of the second support base (171), a sliding post (183) is disposed outside the piston shaft (111), the lateral swinging portion (182) is provided with a sliding groove (184) that cooperates with the sliding post (183), and the third support base (181) is provided with a sliding rail (185) for overlapping the sliding post (183); and the lateral swinging portion (182) is swung to enable the sliding groove (184) to drive the sliding post (183) to slide on the sliding rail (185), to further drive the piston shaft (111) to move in the outer cylinder (112).

8. The non-electric toy transmission system according to claim 1, wherein the transmission medium is gas or liquid.

* * * * *